US008337339B2

(12) United States Patent
Hamann

(10) Patent No.: US 8,337,339 B2
(45) Date of Patent: Dec. 25, 2012

(54) FLOATING GYRATING SWIMMING POOL EXERCISE BALL GAME

(76) Inventor: David L Hamann, Cincinnati, OH (US)

( * ) Notice: Subject to any disclaimer, the term of this patent is extended or adjusted under 35 U.S.C. 154(b) by 14 days.

(21) Appl. No.: 11/441,543

(22) Filed: May 27, 2006

(65) Prior Publication Data

US 2006/0276271 A1 Dec. 7, 2006

Related U.S. Application Data

(60) Provisional application No. 60/687,749, filed on Jun. 6, 2005.

(51) Int. Cl.
*A63B 67/00* (2006.01)

(52) U.S. Cl. ..... 473/466; 273/350

(58) Field of Classification Search ..... 473/466, 473/485; 273/336, 440, 350; 405/25
See application file for complete search history.

(56) References Cited

U.S. PATENT DOCUMENTS

| | | | | |
|---|---|---|---|---|
| 2,130,820 | A * | 9/1938 | Trumbull | 473/470 |
| 3,652,090 | A * | 3/1972 | Semmens | 273/336 |
| 4,093,225 | A * | 6/1978 | Oliver | 473/575 |
| 5,462,284 | A * | 10/1995 | Felsenthal | 473/473 |
| 5,505,645 | A * | 4/1996 | Engler, Jr. | 441/1 |
| 2002/0028716 | A1 * | 3/2002 | Gormley | 473/423 |

* cited by examiner

*Primary Examiner* — Gene Kim
*Assistant Examiner* — M Chambers

(57) ABSTRACT

The invention is a floatation game device with a pole, which pole has a first (upper) end, a second (lower) end, and an intermediate section(s). A ballast weight is attached to the lower end. A generally ovoid and round float is attached to the intermediate section. A rope connector is attached to the upper end. One end of a rope is attached to the upper end of the pole and a ball is attached to the other end of the rope. The pole of the floatation game device can be disassembled into smaller sections. The attachment means can be a swivel, a hole, or other attachment means.

6 Claims, 4 Drawing Sheets

FLOATING GYRATING SWIMMING POOL EXERCISE BALL GAME

Priority claimed to 60/687,749 filed Jun. 6, 2005.

FIELD OF INVENTION

The invention is concerned with devices for fun and exercise that float in swimming waters such as swimming pools. More specifically the present invention is concerned with tether ball games, especially those that can gyrate and move in a generally unpredictable manner.

BACKGROUND OF INVENTION

In the hot lazy days of summer a common activity for young people is to swim and play in swimming pools. Such activities include simple swimming, competitive racing swimming, and simply lying on a flotation device. In addition, floatation devices to provide food and beverages are common. An example of such floatation devices is taught in U.S. Pat. No. 5,505,645, Floatable Assembly for Swimming Pools by Engler. Engler provides for a stable upright pole with a floatation device that has holes to retain cups and such. Engler likewise teaches his floating assembly can be used for various games such as basketball and tethered ball.

Engler teaches a stable flotation device that retains an essentially level contact with the surface of the pool water. For this end, he teaches that the upright pole of his invention has a joint so that as the pole is forced out of perpendicular, the float remains stable. For this reason the top end of his pole is designed to remain vertical whether topped with an umbrella, a tether ball, or a basket for basketball. His abstract states "A float surrounding the pole intermediate the ends of the later is connected to the pole by a universal coupling which permits the float to move with wave action while the pole remains substantially stationary."

The structure of the present invention is designed to move the upper end of the pole in an erratic manner to add skill and fun to the tether ball game. The tether ball game structure of the present invention with advantages will be described below.

SUMMARY OF INVENTION

The invention is a floatation game device with a pole fixed perpendicular to the float, which pole has a first (upper) end, a second (lower) end, and intermediate section(s). A ballast weight is affixed or optionally pivotally attached to the lower end. A generally ovoid and round float is affixed to the intermediate section. A rope connecting means is attached to the upper end. One end of a rope is attached to the connecting means at the upper end of the pole and a ball is attached to the other end of the rope. The pole of the floatation game device can be disassembled into smaller sections. The attachment means can be a swivel element, a hole in the upper end of the pole, a hoop (honda) or other attachment means. A honda is the small reinforced loop at then end of a lariat (cattleman's rope). The fixed perpendicular pole and float arrangement causes exaggerated bobbing and tethering when the pole is forced out of its vertical rest position.

DETAILED DESCRIPTION OF FIGURES

Figure 1:
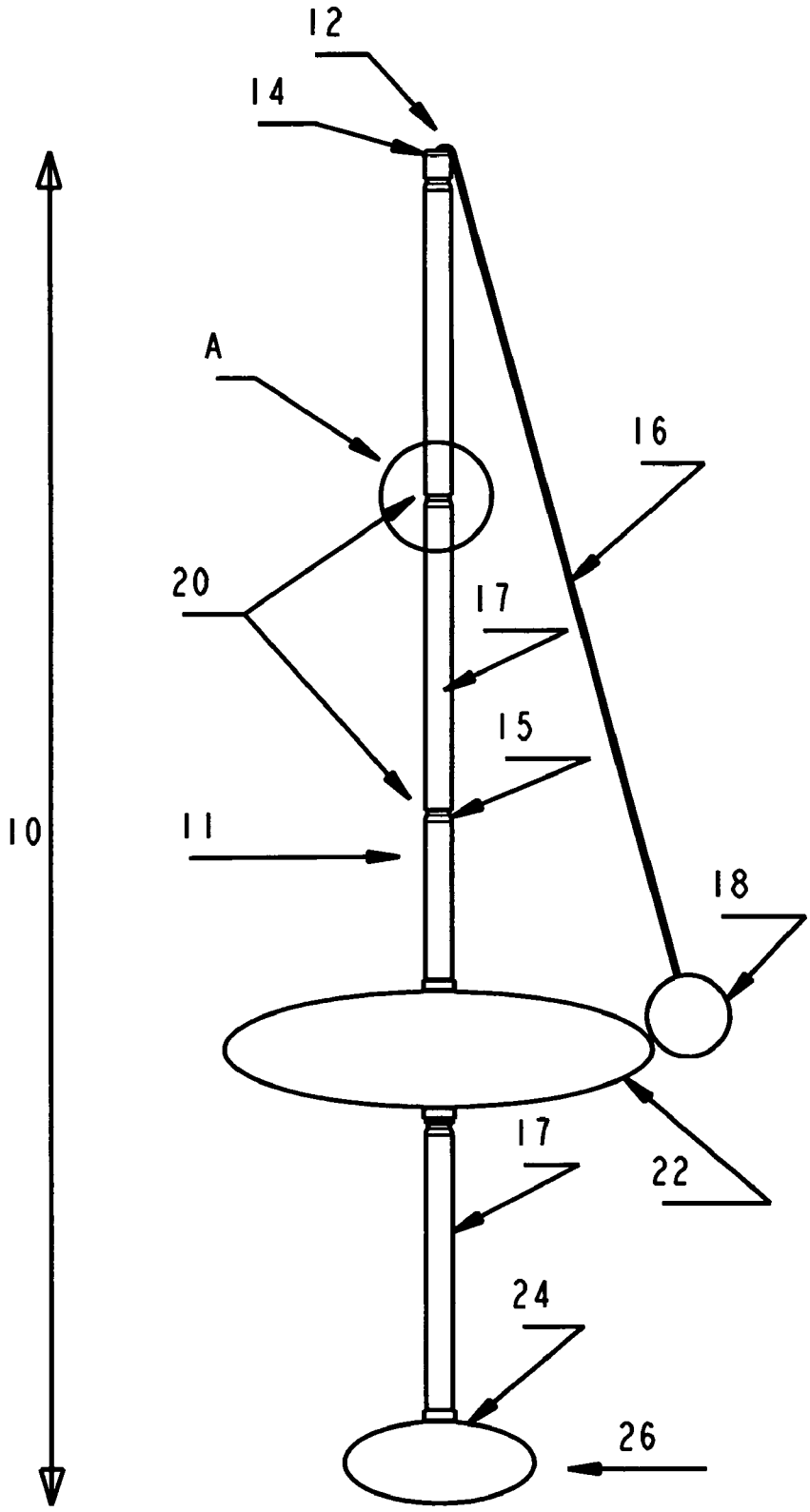
FIG. 1 shows floating gyrating swimming pool exercise ball game device.

FIG. 1 shows floating gyrating swimming pool exercise ball game device 10. The device 10 has a pole 11 with a first end 12. Pole 11 may have 2 or more subsections 17 affixed by joints 15. Attached to that first end 12 is a rope attachment means 14 which may or may not have a swivel or a hole. Rope 16 connects attachment means 14 and the ball 18. Float part 22 attaches to intermediate section 20. Float part 22 is ovoid in shape (viewed from the side as in this figure) to aid the erratic gyrating action of game ball 18. Second end 24 has a ballast 26 to urge pole 11 first end 12 with rope 16 and ball 18 to an upright position. As the game is played the participants constantly hit the ball in different directions. Ballast 26 constantly urges first end 12 into a upright position. Circle section A outlines joint 15.

Figure 2:
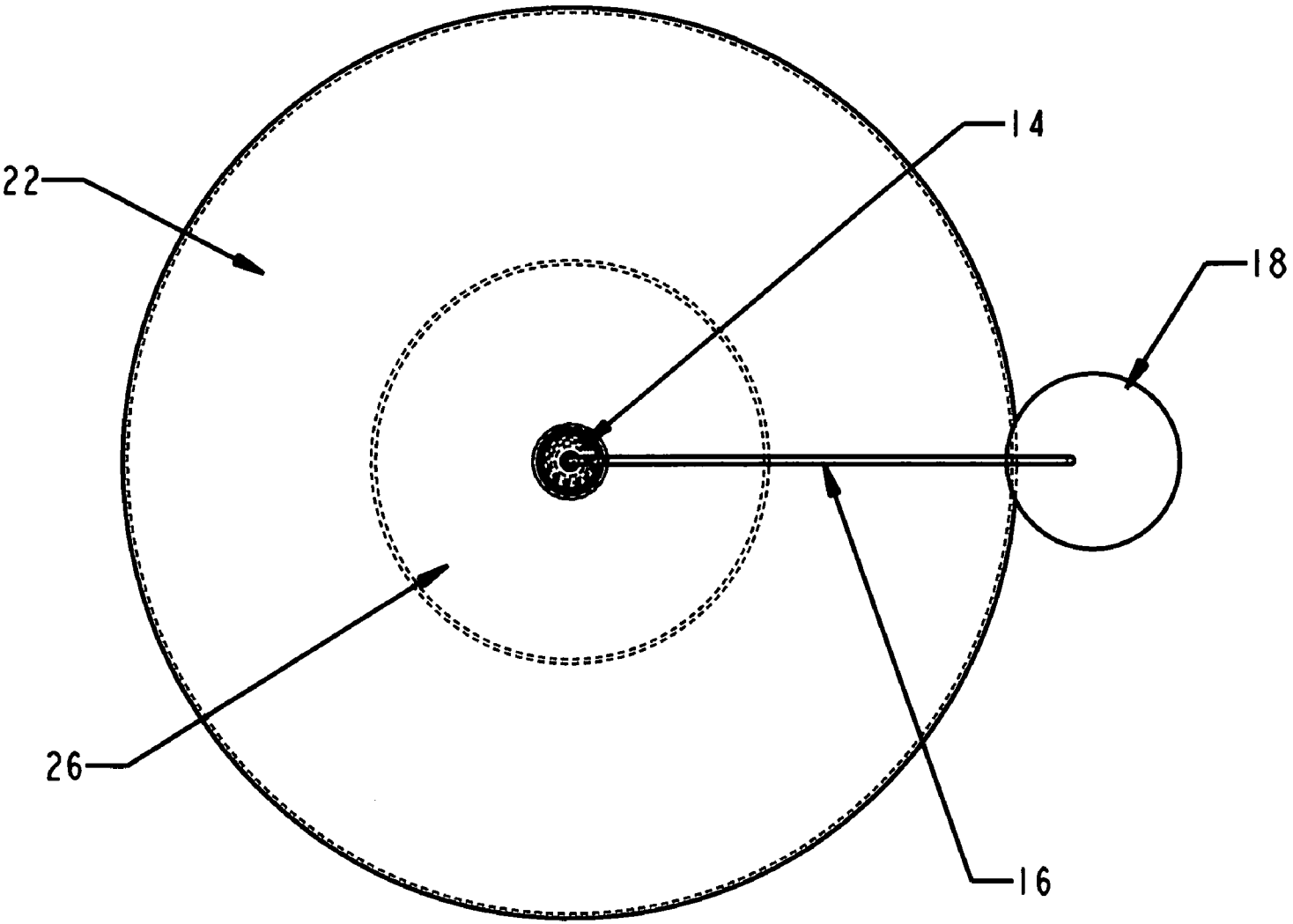
FIG. 2 shows a top view of device.

FIG. 2 shows a top view of device 10. Shown is first end rope attachment means 14. Rope attachment means 14 connects to rope 16 with ball 18 at second end. Note, float part 22 is round from top view. Ballast 26 is shown in outline.

Figure 3:
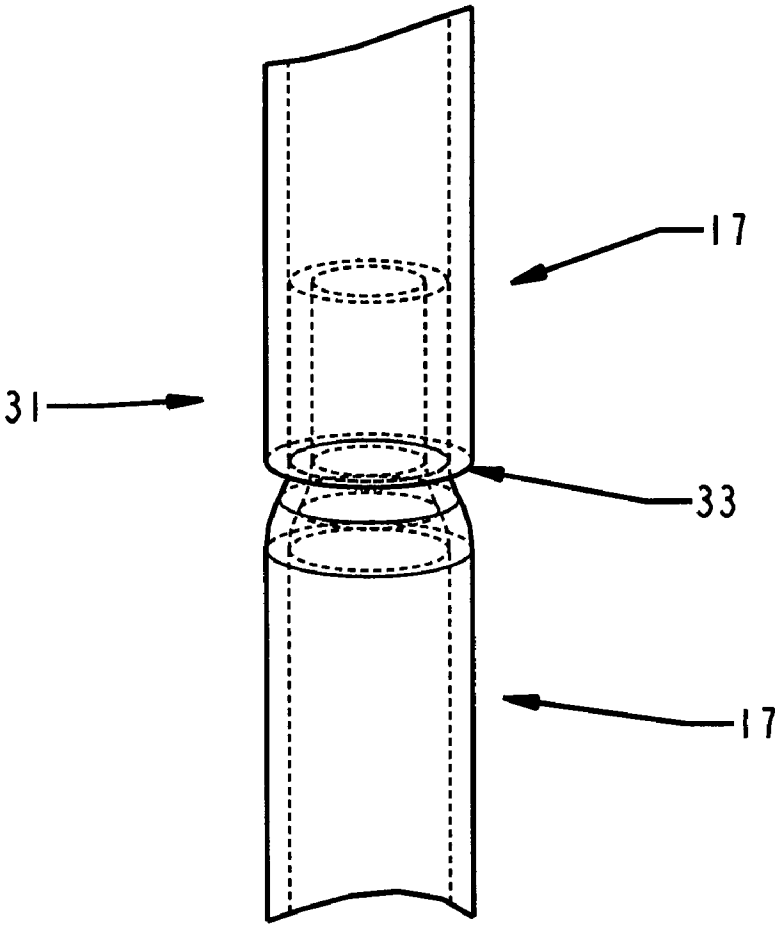
FIG. 3 shows detail of joint as outlined as circle A in FIG. 1.

FIG. 3 shows detail of joint 15 as outlined as circle A in FIG. 1. Sections 17 have a wide end 31 and a narrowed end 33. Narrowed end 33 fits within wide end 31.

Figure 4:
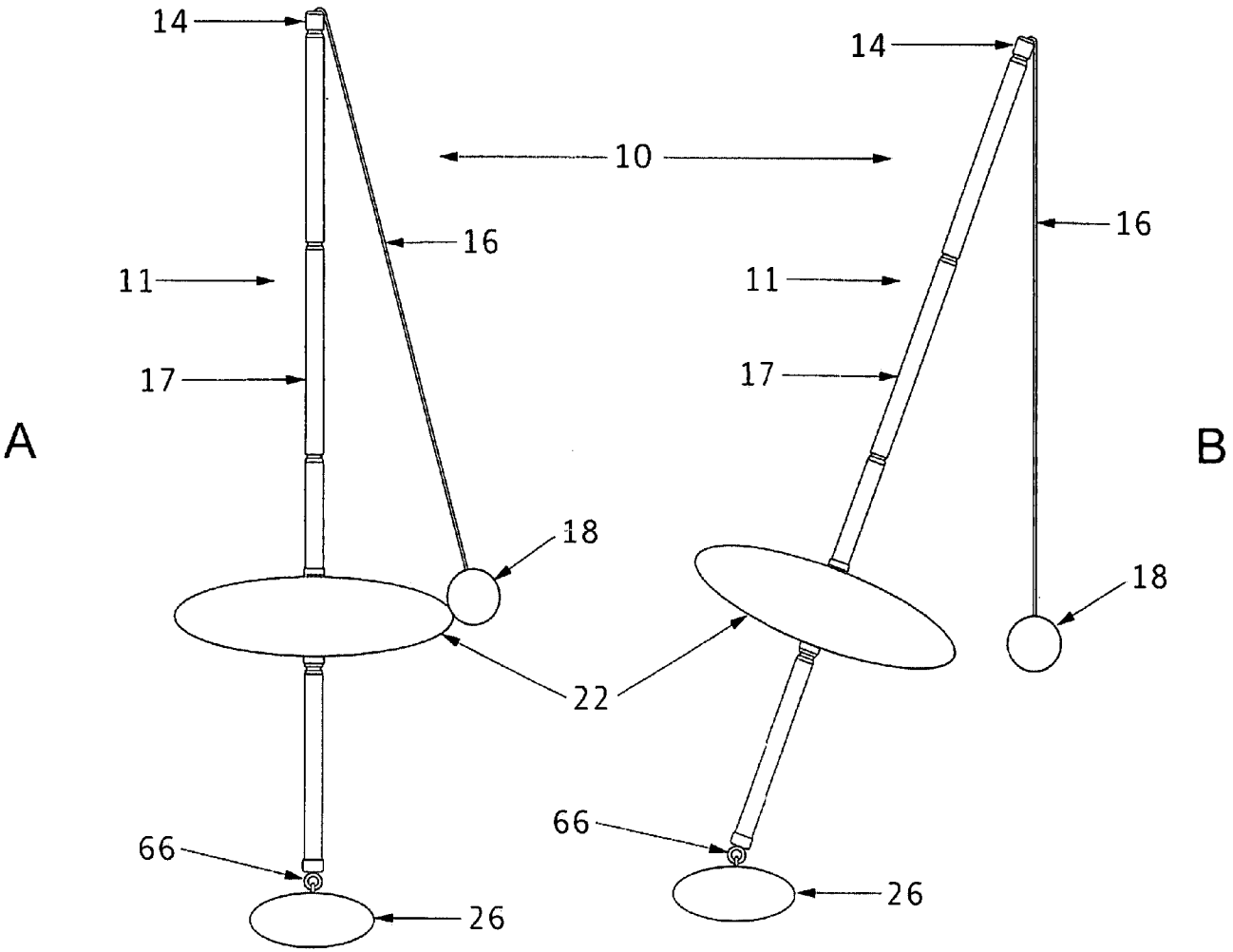
FIG. 4 shows floating gyrating swimming pool exercise ball game device 10 in upright position A and in an unbalanced position B.

FIG. 4 shows floating gyrating swimming pool exercise ball game device 10 in upright position A and in an unbalanced position B. The device 10 has a pole 11 with a first end 12. Pole 11 may have 2 or more subsections 17 affixed by joints 15. Attached to that first end 12 is a rope attachment means 14 which may or may not have a swivel or a hole. Rope 16 connects attachment means 14 and the ball 18. Float part 22 attaches to intermediate section 20. Float part 22 is ovoid in shape (viewed from the side as in this figure) to aid the erratic gyrating action of game ball 18. Second end 24 has a ballast 26 to urge pole 11 first end 12 with rope 16 and ball 18 to an upright position. Note pivot joint 66 attached to ballast weight 26. As the game is played the participants constantly hit the ball in different directions. Ballast 26 constantly urges first end 12 into a upright position. Pivot joint 66 will alter the gyration motion of the ball as seen in FIG. 4 B.

I claim:

1. A device for providing gyration and unpredictable motion while floating on the surface of water, exaggerating bobbing and tethering for the purpose of adding skill, fun and exercise to the game of tetherball comprising:

a pole with a first end, a second end, and intermediate section(s);

affixed to said second end is a ballast weight;

a generally ovoid and round float is affixed in a perpendicular arrangement to said intermediate section;

an attachment means is affixed to said first end;

a rope with a fist end and a second end;

said first end of said rope is attached to said attachment means;

a ball is affixed to said second end of said rope;

said perpendicular arrangement of said float and said intermediate section associated with said second end and said ballast weight comprises a force applier; said force applier acting on said first end and said rope effecting erratic gyrating action of said ball.

2. A floatation game device as in claim 1 wherein said pole can be disassembled into smaller sections.

3. A floatation game device as in claim 1 wherein said attachment means for said rope is a hole in said first end of said pole.

4. A floatation game device as in claim 1 wherein said first end of said pole has a swivel element to attach said rope.

5. A floatation game device as in claim 1 wherein said attachment means is a hoop or honda.

6. A floatation game device as in claim 1 wherein said second end is pivotally attached to said ballast weight.

* * * * *